US006896161B2

(12) United States Patent
Pätz

(10) Patent No.: US 6,896,161 B2
(45) Date of Patent: May 24, 2005

(54) CLOSEABLE DISPENSING DEVICE FOR DISPENSING A LIQUID, VISCOUS, OR PASTY MEDIUM CONTAINED IN A CONTAINER

(75) Inventor: Werner Pätz, Hofstetten (DE)

(73) Assignee: BMF GmbH, Riederau (DE)

( * ) Notice: Subject to any disclaimer, the term of this patent is extended or adjusted under 35 U.S.C. 154(b) by 0 days.

(21) Appl. No.: 10/662,631

(22) Filed: Sep. 15, 2003

(65) Prior Publication Data

US 2004/0094580 A1 May 20, 2004

Related U.S. Application Data

(63) Continuation of application No. PCT/DE02/00058, filed on Jan. 10, 2002.

(30) Foreign Application Priority Data

Mar. 15, 2001 (DE) ..... 101 13 109

(51) Int. Cl.[7] ..... B67D 3/00
(52) U.S. Cl. ..... 222/484; 222/561
(58) Field of Search ..... 222/212, 481, 222/481.5, 482, 484, 511, 561; 220/714, 715; 215/311

(56) References Cited

U.S. PATENT DOCUMENTS

| | | | | |
|---|---|---|---|---|
| 732,620 A | * | 6/1903 | Dinkler | 222/397 |
| 2,971,680 A | | 2/1961 | Wilson et al. | |
| 2,979,238 A | * | 4/1961 | Bramming | 222/484 |
| 3,146,913 A | * | 9/1964 | Nagai | 222/110 |
| 3,731,855 A | * | 5/1973 | Vos | 222/394 |
| 3,757,981 A | * | 9/1973 | Harris et al. | 215/247 |
| 5,065,909 A | | 11/1991 | Pino et al. | |
| 5,289,945 A | | 3/1994 | Stradder | |
| 5,620,114 A | | 4/1997 | Chalfa, Jr. | |
| 6,213,351 B1 | | 4/2001 | Stoneberg et al. | |

FOREIGN PATENT DOCUMENTS

| | | |
|---|---|---|
| DE | 183301 | 6/1905 |
| DE | 1 202 157 | 9/1965 |
| EP | 0 332 480 A1 | 9/1989 |
| EP | 0 461 065 A1 | 12/1991 |
| EP | 0 826 607 A1 | 3/1998 |
| GB | 646114 | 11/1950 |
| GB | 2 283 012 A | 4/1995 |
| WO | 01/02264 A1 | 1/2001 |

* cited by examiner

*Primary Examiner*—Gene Mancene
*Assistant Examiner*—Patrick Buechner
(74) *Attorney, Agent, or Firm*—Laurence A. Greenberg; Werner H. Stemer; Gregory L. Mayback

(57) ABSTRACT

A closeable dispensing device for dispensing a liquid, viscous or pasty medium contained in a container has a first opening for dispensing the medium located in the container, a second opening for ventilating and/or venting the container, and a closure device which can be actuated in order to produce and break a connection between the first opening and the container and between the second opening and the container. The dispensing device described is distinguished in that the closure device is designed such that, when actuated as is required in order to produce a connection between the first opening and the container, it first of all produces a connection between the second opening and the container and only then produces the connection between the first opening and the container. Such a dispensing device is straightforward to use and, nevertheless, cannot under any circumstances open of its own accord.

9 Claims, 5 Drawing Sheets

CLOSEABLE DISPENSING DEVICE FOR DISPENSING A LIQUID, VISCOUS, OR PASTY MEDIUM CONTAINED IN A CONTAINER

CROSS-REFERENCE TO RELATED APPLICATION

This application is a continuation of copending International Application No. PCT/DE02/00058, filed Jan. 10, 2002, which designated the United States and which was not published in English.

BACKGROUND OF THE INVENTION

Field of the Invention

The present invention pertains to a closeable dispensing device for dispensing a liquid, viscous or pasty medium contained in a container. The device has a first opening for dispensing the medium from the container, a second opening for ventilating and/or venting the container, and a closure device which can be actuated in order to produce and break a connection between the first opening and the container and between the second opening and the container.

Such dispensing devices can be used, for example, on drinks bottles for children or cyclists.

A dispensing device which is suitable for drinks bottles is described in German patent application DE 199 37 754 A1. The dispensing device described there is a device which can be positioned on a drinks bottle and comprises a part which, once positioned on the drinks bottle, is fixed and a nipple which can be moved relative to the part, or more precisely can be pushed into it and drawn out of it. The nipple has a channel running through it, via which the drinks bottle is connected to a drinking opening provided at the top end of the nipple. This channel is closed in the state in which the nipple has been pushed into the fixed part (pushed onto a stopper closing the channel) and is open in the drawn-out state. The said dispensing device also contains measures which are intended to ensure that the channel is completely closed in the closed position of the nipple, and that the nipple cannot leave the closed position of its own accord but, on the other hand, can be moved into and out of the closed position with only a small amount of force being applied. These measures are embodied by latching elements which are provided on the nipple and, in the closed position, latch into associated latching elements of the fixed part, the latching elements which are provided on the fixed part of the dispensing device being arranged on elastically moveable elements which are accessible from outside of the dispensing device.

The fact that the dispensing device can be closed in a sealed manner, and cannot open of its own accord, is an important precondition in allowing the drinks bottle also to be used for carbonated beverages. In the case of dispensing devices which do not satisfy the abovementioned requirements, the positive pressure produced in the drinks bottle by the carbon dioxide can cause the dispensing device to open of its own accord, which may result in the beverage located in the drinks bottle running out, and in gases flowing out (a reduction in the carbon-dioxide content of the beverage). It goes without saying that both of these occurrences are undesirable.

The measures which have been taken in order to satisfy the above-mentioned conditions in the case of the dispensing device known from German patent application DE 199 37 754 A1 do not optimally satisfy these conditions: it cannot reliably be ensured that the dispensing device does not open of its own accord and, furthermore, the dispensing device is more complicated to use (the operations of closing and, in particular, opening the dispensing device).

German patent DE 183301 C discloses a dispensing device which, as a closure device which can be actuated in order to produce and break a connection between the container and the opening for dispensing the medium contained in the container, is formed by a slide which can be displaced transversely to the connection between the opening and the container. Such a slide makes it possible, with relatively low outlay, to close the connection between the opening and the container in a sealed manner; the slide cannot under any circumstances be moved into the open position by a positive pressure or negative pressure prevailing in the container. However, when there is a positive pressure or a negative pressure prevailing in the container, it is necessary to apply a considerable amount of force in order to actuate the slide.

SUMMARY OF THE INVENTION

It is accordingly an object of the invention to provide a dispensing device, which overcomes the above-mentioned disadvantages of the heretofore-known devices and methods of this general type and which, on the one hand, provides a particularly good sealing closure and, on the other hand, is straightforward to actuate even when there is positive pressure or negative pressure prevailing in the container.

With the foregoing and other objects in view there is provided, in accordance with the invention, a closeable dispensing device for dispensing a liquid, viscous or pasty medium from a container. The dispensing device comprises:

a dispensing device body formed with a first opening for dispensing the medium from the container and a second opening for ventilating and/or venting the container;

an actuatable closure device configured to selectively establish a communicating connection between said first opening and the container and between said second opening and the container;

said closure device, upon being actuated for establishing a connection between said first opening and the container, first establishing a communicating connection between said second opening and the container and only then establishing the connection between said first opening and the container; and wherein the communicating connection between said second opening and the container is interrupted when the communicating connection between said first opening and the container is established.

In other words, the dispensing device according to the invention is distinguished in that the closure device is designed such that, when actuated as is required in order to produce a connection between the first opening and the container, it first of all produces a connection between the second opening and the container and only then produces the connection between the first opening and the container.

The use of such a dispensing device proves to be advantageous because even a closure device which is more difficult to move as a result of positive pressure or negative pressure prevailing in the container can be actuated by it with only a small amount of force being applied. This applies, in particular, once the closure device has produced a connection between the second opening and the container. A positive pressure or negative pressure prevailing in the container can then dissipate via the second opening, with the result that the closure device is subject to lower forces than would be the case without the pressure equalization.

It is thus possible for even a closure device which gives a particularly good sealing closure, for example a slide of the type described in the above-mentioned German patent DE 183301 C, or some other closure device which is more difficult to open as a result of a positive pressure or negative pressure prevailing in the container to be actuated with only a small amount of force being applied.

Furthermore, the pressure equalization when the first opening is not yet connected to the container also proves to be advantageous because, as a result, none of the medium contained in the container can spray out of the dispensing device when the dispensing device is opened: nothing can spray out of the first opening because, when the first opening is connected to the container, there is no positive pressure or negative pressure prevailing in the container on account of the preceding pressure equalization via the second opening; at most only a negligibly small amount, if anything at all, can spray out of the second opening because the second opening, in order to perform the task intended for it, i.e. to ensure ventilation or venting of the container, may be very small.

The fact that the operations of ventilating and venting the container, on the one hand, and of dispensing medium contained in the container, on the other hand, is effected via different openings of the dispensing device also proves to be advantageous because this can prevent an individual who is opening the dispensing device using his/her mouth, or who positions the first opening in his/her mouth as the dispensing device is being opened, from being able to, or having to, breathe in gases which pass out of the second opening as the container is vented; in the case of carbonated beverages, these gases contain carbon dioxide, which can make one feel unwell if breathed in and, in particular when one is exhausted, may even result in a brief period of unconsciousness.

Other features which are considered as characteristic for the invention are set forth in the appended claims.

Although the invention is illustrated and described herein as embodied in a closeable dispensing device for dispensing a liquid, viscous or pasty medium contained in a container, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

The dispensing devices which will be described hereinbelow are designed for use on a drinks bottle; a liquid (a beverage) contained in the drinks bottle can be poured out or drunk via the dispensing devices.

It will be readily understood, however, that the dispensing devices are not restricted to such a use. It is also possible for the dispensing devices—if appropriate following corresponding adaptation to the given conditions—to be used for containers other than a drinks bottle, and for them to dispense different liquid, viscous or pasty media, for example medicaments, soaps, oils, perfumes, detergents, etc.

Figure 1:
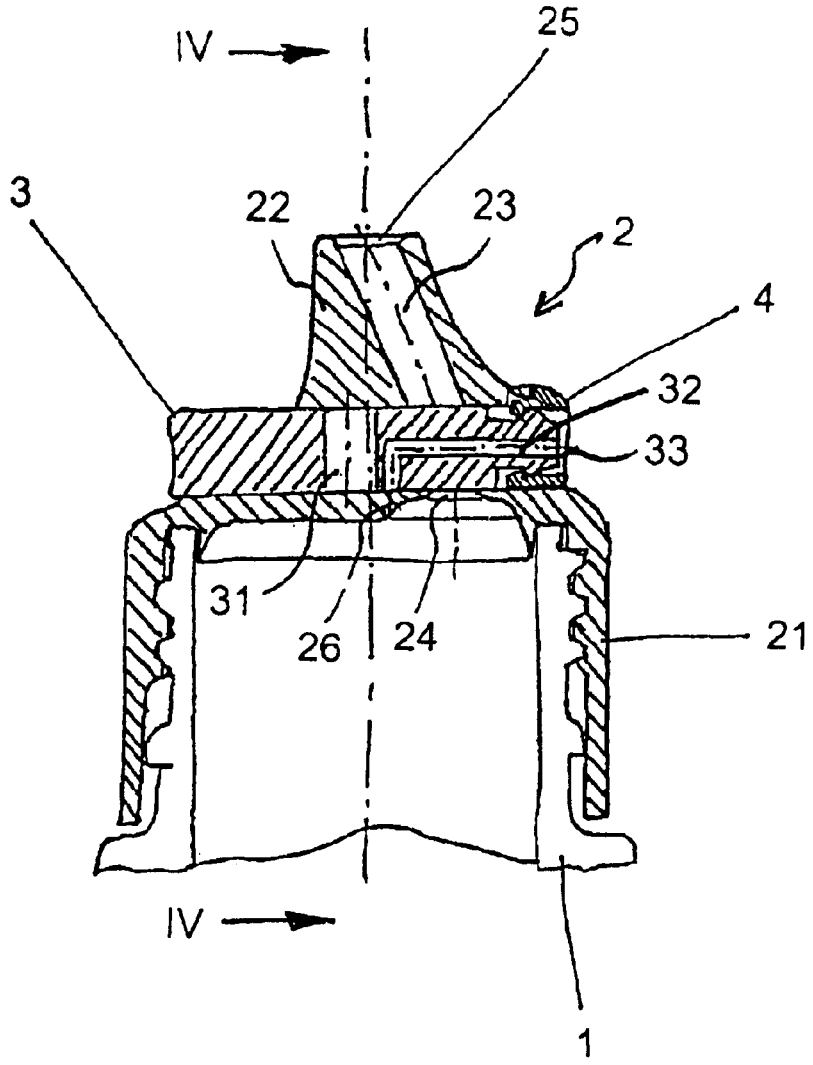
FIG. 1 is a cross section through a first dispensing device, in a state in which neither the medium which is to be dispensed by the dispensing device nor gases can pass out.

Referring now to the figures of the drawing in detail and first, particularly, to FIG. 1 thereof, the dispensing devices described are screwed onto the neck 1 of a bottle. It is not absolutely necessary, however, for the dispensing devices to be fastened on the neck 1 by being screwed onto the same. It is also possible for fastening to take place in any other desired manner, for example by plugging on, plugging in, screwing in, adhesive bonding, etc.

The first dispensing device, which is shown in FIGS. 1 to 4, comprises a spout part 2 which is fixed (in the state in which the dispensing device has been fastened on the neck 1 of the bottle), a slide 3, which is plugged through the spout part 2 and can be moved relative to the spout part 2, and a cap 4 positioned at one end of the slide 3.

The spout part 2 comprises a fastening portion 21, for fastening the spout part 2 on the neck 1, and a spout 22 which, in the example in question, serves for dispensing the liquid contained in the bottle. The shape and the size of the spout 22 are selected such that an individual can insert the spout into his/her mouth and drink therefrom; in the example in question, the spout 22 is of frustoconical design. It should be pointed out at this juncture that it is also possible for the spout 22 to be of any other desired shape; the size and the shape of the spout are preferably made dependent on the intended use of the dispensing device.

Figure 3:
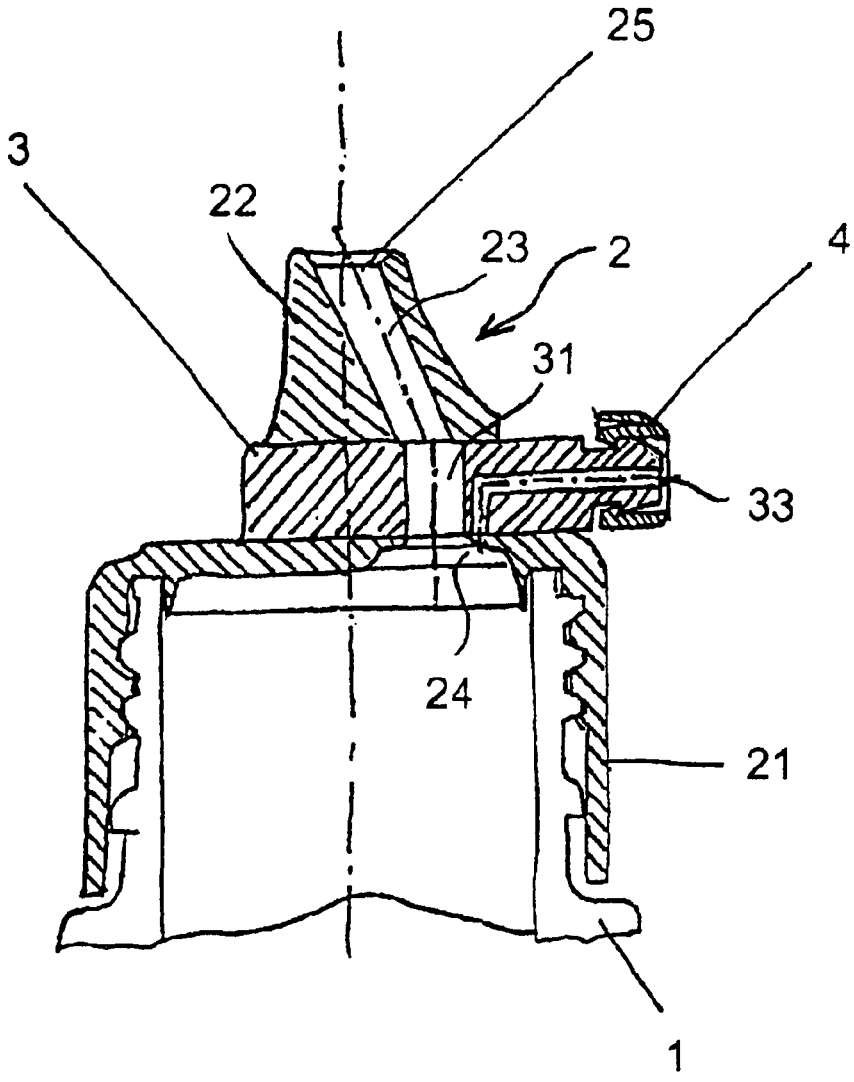
FIG. 3 is a cross section through the dispensing device shown in FIGS. 1 and 2, in a state in which the medium which is to be dispensed by the dispensing device can be removed.
Figure 4:
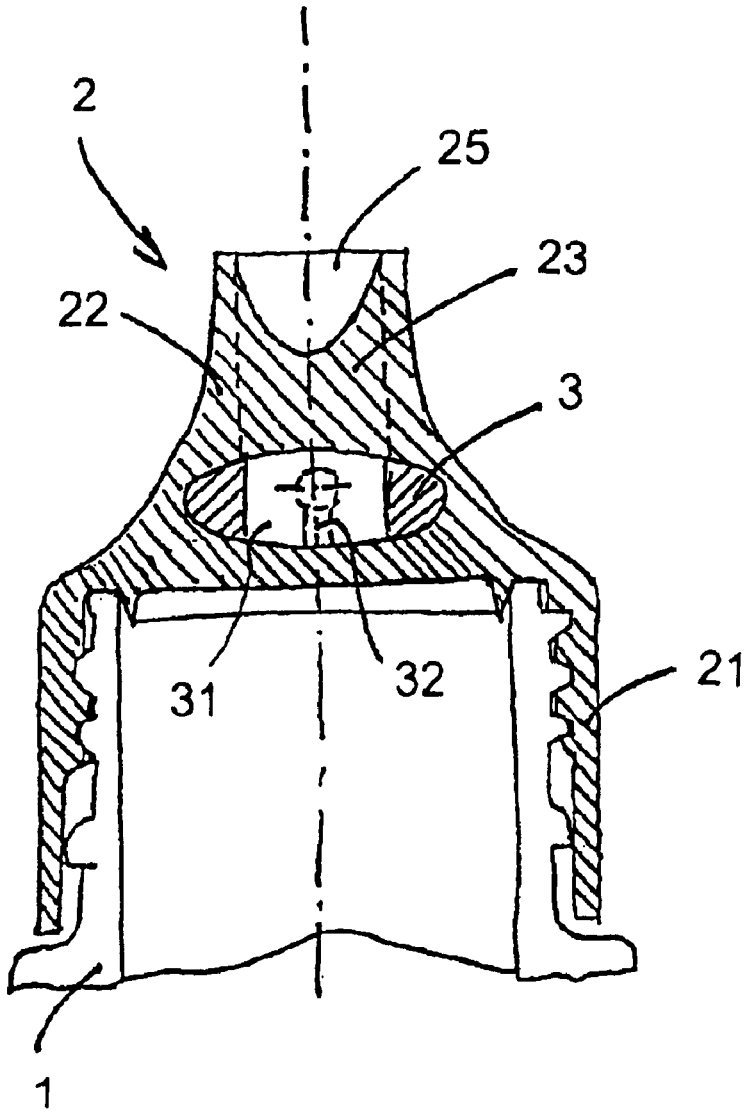
FIG. 4 is a different sectional illustration of the dispensing device shown in FIG. 1 and taken along the line IV—IV.

In the open state, which is shown in FIG. 3, the dispensing device has a channel, comprising three channel parts 23, 24 and 31, running through it, the channel connecting the interior of the bottle to an outlet opening 25 provided at the top end of the spout 22; via this channel, with the dispensing device in the open state shown in FIG. 3, the liquid contained in the bottle passes to the outlet opening 25.

Of the three channel parts 23, 24 and 31:

the channel part 23 is a channel part which is provided in the spout part 2 (in the spout 22 of the same) and extends to the outlet opening 25 from the top side of an opening which accommodates the slide 3, the channel part 24 is a channel part which is likewise provided in the spout part 2 and extends to the neck 1 from the underside of the opening which accommodates the slide 3, and the channel part 31 is a constituent part of the slide 3.

The portion 26 of the spout part 22, said portion having the channel part 24 running through it, has the special feature that it is thin enough for it to be pressed elastically upwards against the slide 3 by the positive pressure which is produced in the bottle during normal usage.

The slide 3 serves as a closure device. It allows the dispensing device to be moved from the closed state into the open state and vice versa.

The slide 3 is an elongate element with an oval cross section and is plugged into an opening of the spout part 2 running above the neck 1, transversely to the latter, and it can be displaced in the longitudinal direction relative to the spout part 2. It should be pointed out at this juncture that the slide 3 and the opening in the spout part 2 which is assigned to it need not have an oval cross section. It is also possible to use any other desired cross sections. The important factors, however, are that the cross sections of the slide 3 and associated opening coincide, that the outer dimensions of the slide 3 correspond as precisely as possible to the inner dimensions of the opening, and that the slide 3 is guided in a rotationally fixed manner in the opening.

By virtue of the slide 3 being displaced, the channel part 31 contained therein is also displaced. In that position of the slide 3 which is shown in FIG. 3, the channel parts 23, 24 and 31 are aligned with one another. This gives rise to a continuous channel from the interior of the bottle to the outlet opening 25; the dispensing device is open, and liquid can be removed from the bottle via the outlet opening 25.

Figure 2:
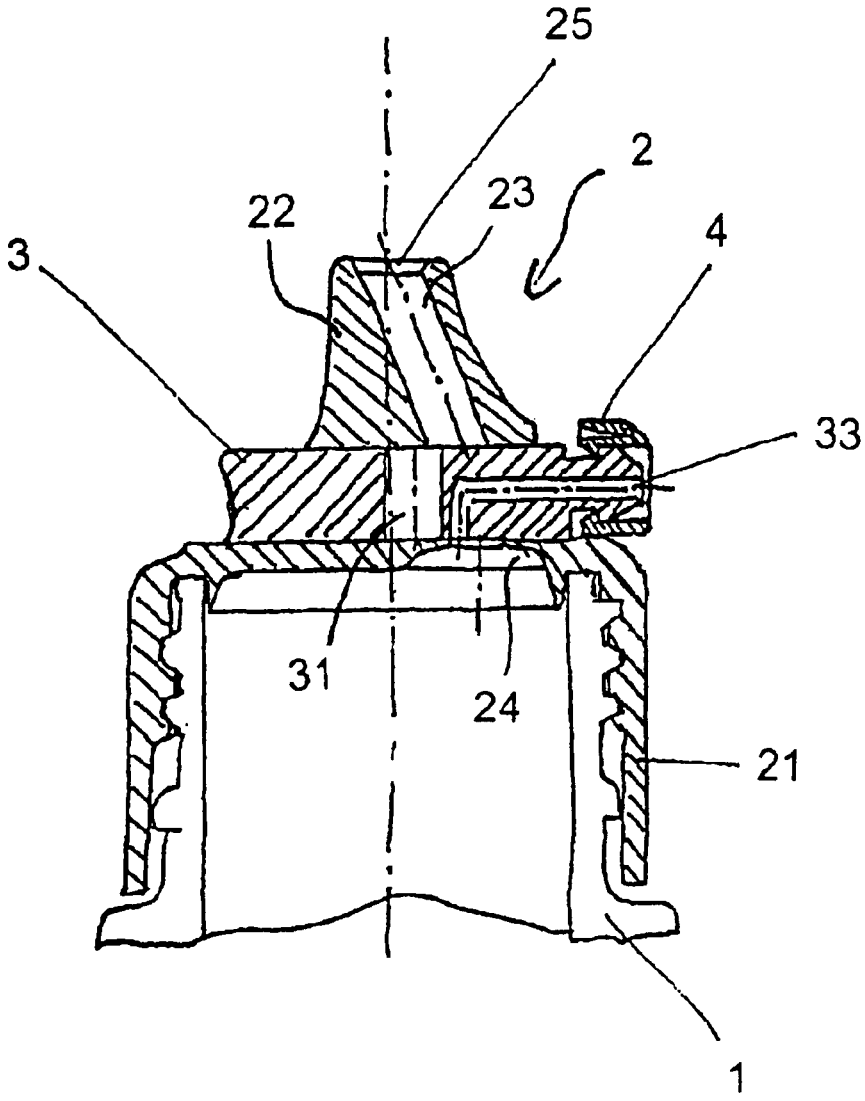
FIG. 2 is a cross section through the dispensing device shown in FIG. 1, in a state in which gases, but not the medium which is to be dispensed by the dispensing device, can pass out.

In the state shown in FIG. 2, in which the slide 3 has been displaced a little way to the left, the channel part 24 and the channel part 31 no longer overlap, as a result of which there is no longer a continuous channel from the interior of the bottle to the outlet opening 25 and, consequently, it is no longer possible for liquid to pass from the bottle to the outlet opening 25.

In the state which is shown in FIG. 1, the slide 3 has been displaced further to the left, with the result that there is likewise no continuous channel between the interior of the bottle and the outlet opening 25 and, consequently, it is likewise not possible for liquid to pass from the bottle to the outlet opening 25.

In addition to the channel part 31, the slide 3 also contains a further channel 32. This channel 32, which will be referred to hereinbelow as a pressure-equalizing channel, begins on the right alongside the channel part 31 on the underside of the slide 3, extends a little way upwards from there, then bends off to the right and, from there, runs in the longitudinal direction of the slide 3 as far as a pressure-equalizing opening 33 provided at the right-hand end of the slide 3. The precise course taken by the pressure-equalizing channel 32 is of secondary importance. The important factor, in particular, is that, during the movement of the slide 3 which has to be executed in order to move the dispensing device from the closed state, which is shown in FIG. 1, into the open state, which is shown in FIG. 3, a connection between the interior of the bottle and the pressure-equalizing opening 33 is produced via the pressure-equalizing channel 32 before the channel part 31 reaches the channel part 23 and/or the channel part 24. It would also be possible for the pressure-equalizing opening to be provided at some other location. However, it is preferably not located in the vicinity of the outlet opening 25.

The pressure-equalizing channel 32 serves for venting the bottle before the dispensing device is opened. Such venting proves to be advantageous because, on account of the force to which the slide 3 is subjected by a positive pressure prevailing in the bottle being eliminated, said slide can be moved, from then on, with only a small amount of force being applied, and because it is thus possible to prevent the situation where, when the dispensing device is opened, liquid sprays out of the outlet opening 25 on account of a positive pressure prevailing in the bottle.

Furthermore, the fact that the venting, rather than taking place via the outlet opening 25, takes place via the pressure-equalizing opening 33, which is provided at a different location, has the advantage that there is no risk of an individual who is opening the dispensing device using his/her mouth, or who positions the first opening in his/her mouth as the dispensing device is being opened, being able to, or having to, breathe in the gases which pass out of the second opening as the container is vented. In particular when the bottle contains a carbonated beverage, the act of breathing in these gases is not unproblematic. This is because the gas which passes out in this case is carbon dioxide and, if the person wishing to drink from the bottle breathes this in, he/she could suffer from a depletion of oxygen and the associated side effects.

It is also possible for ventilation, i.e. an equalization of a negative pressure prevailing in the bottle, to take place via the pressure-equalizing opening 33. A negative pressure may be produced in the bottle, for example, if the liquid located in the bottle cools when the dispensing device is closed and/or if the bottle is closed at low air pressure (for example on a mountain) and opened again at high air pressure (for example in the valley). Ventilation of the bottle also results in the slide being easier to move.

The pressure-equalizing channel 32 is preferably very much narrower than the channel leading to the outlet opening 25. This prevents liquid from being able to spray out of the pressure-equalizing opening 33.

In the closed state of the dispensing device, which is shown in FIG. 1, neither the channel part 31 of the slide 3 nor the pressure-equalizing channel 32 of the slide overlap with the channel part 24. It is thus not possible either for liquid to pass out of the outlet opening 25 or for gas to escape via the pressure-equalizing opening 33. It is not possible either for any liquid or gas to pass out between the slide 3 and the spout part 2. The cross sections of the slide 3 and of the opening accommodating the latter are identical, with the result that there are no interspaces between the slide 3 and spout part 2 via which liquid or gas could escape. Sealing is also provided when a positive pressure forms within the bottle, be this as a result of a change in temperature, or as a result of a change in air pressure, or as a result of a carbonated drink, or as a result of some other circumstances.

As a result of a positive pressure which may be established, the portion 26 of the spout part 2, said portion containing the channel part 24, is pressed elastically upwards against the slide 3, this preventing either liquid or gases from escaping from the bottle.

The cap 4, which has already been mentioned in the introduction, is positioned at the right-hand end of the slide and in the closed state of the dispensing device, which is shown in FIG. 1, strikes against the spout part 2. This cap 4 may be dispensed with if the end of the slide 3 on which, in the example in question, the cap 4 is positioned has a corresponding thickened portion which can be used as a stop.

If one wishes to open the dispensing device, that end of the slide 3 which is illustrated on the left-hand side in the Figs. has to be forced into the spout part 2. If a positive pressure has formed in the bottle, this may be associated with a slightly increased amount of force having to be applied until the position shown in FIG. 2 has been reached.

In the state which is shown in FIG. 2, the slide 3 has been forced into the spout part 2 to the extent where the pressure-equalizing channel 32 ends up located above the channel part 31. In this state, a positive pressure or negative pressure present in the bottle can be dissipated via the channel part 24, the channel 32 and the pressure-equalizing opening 33. In this state, the channel part 31 has not yet reached the channel part 24, with the result that it is still not possible for any liquid to pass to the outlet opening.

The dissipation of the positive pressure or negative pressure prevailing in the bottle allows the slide 3, from then on, to be pushed very easily into the spout part 2.

The state which is shown in FIG. 3 is finally achieved by continued pushing of the slide 3 into the spout part 2. In this state, the channel parts 23, 24 and 31 end up located one above the other and thus form a continuous channel from the bottle to the outlet opening 25, as a result of which liquid can be removed from the bottle. At the same time, the channel 32 is no longer located above the channel part 24, as a result of which it is no longer possible for any gas to pass out or in via the pressure-equalizing opening 33. In the example in question, the pressure-equalizing channel 32 is already disconnected before a connection is produced between the interior of the bottle and the outlet opening 25. This is particularly advantageous because the situation where liquid passes out via the pressure-equalizing opening 33 as one is drinking from the bottle can thus be reliably ruled out. It would also be possible, however, to make provision for the pressure-equalizing channel 32 still to be wholly or partially open as the connection between the interior of the bottle and the outlet opening 25 begins to be produced, and only to be closed at a more or less later point in time. In particular if the pressure-equalizing channel 32 and/or the pressure-equalizing opening 33 are/is very small, or to be more precise have/has such a small cross section, or are/is so small, that only a very negligibly small amount of liquid, if any at all, can pass out via the same, provision can nevertheless also be made, on the other hand, for the pressure-equalizing channel 33 likewise still to be wholly or partially open when there is a connection between the interior of the bottle and the outlet opening 25; it would then also be possible for pressure equalization to take place via the pressure-equalizing opening 33 as one is drinking, as a result of which the act of drinking would have to be broken off less frequently, if at all, in order for the positive pressure or negative pressure produced as one is drinking to be equalized.

In order for the bottle to be closed again, the slide 3 has to be pushed into the spout part 2, until it stops, from its end which is illustrated on the right-hand side in the figures. The state which is shown in FIG. 1 is thus reached again.

The dispensing device described also has two further special features.

One of the special features is that the channel leading from the bottle to the outlet opening 25 begins at an eccentric location, as seen in the plan view of the dispensing device, and also outside the centre of the bottle neck. This makes it possible to achieve the situation where in the closed state of the dispensing device, which is shown in FIG. 1, the slide 3 does not project laterally beyond the bottle neck 1. This would not be possible if the channel leading to the outlet opening 25, or more precisely the channel part 24 thereof, and the bottle neck 1 were arranged coaxially.

The second of the abovementioned special features is that the channel leading to the outlet opening 25, rather than running straight upwards, slopes. This makes it possible to achieve the situation where the dispensing device, despite its asymmetrical construction, has a centre of gravity which is located in the middle. This proves to be advantageous because the dispensing device, by virtue of being oscillated, can thus be moved quickly into a position in which it can be gripped by a gripper and positioned on the bottle neck.

The above-described construction of the dispensing device means that, irrespective of the details of the practical realization, the dispensing device

- is liquid- and gas-tight in the closed state,
- cannot be opened by a positive pressure or a negative pressure prevailing in the container, and
- can nevertheless be closed straightforwardly under all circumstances, in particular even when there is a positive pressure or a negative pressure prevailing in the container.

Figure 5:
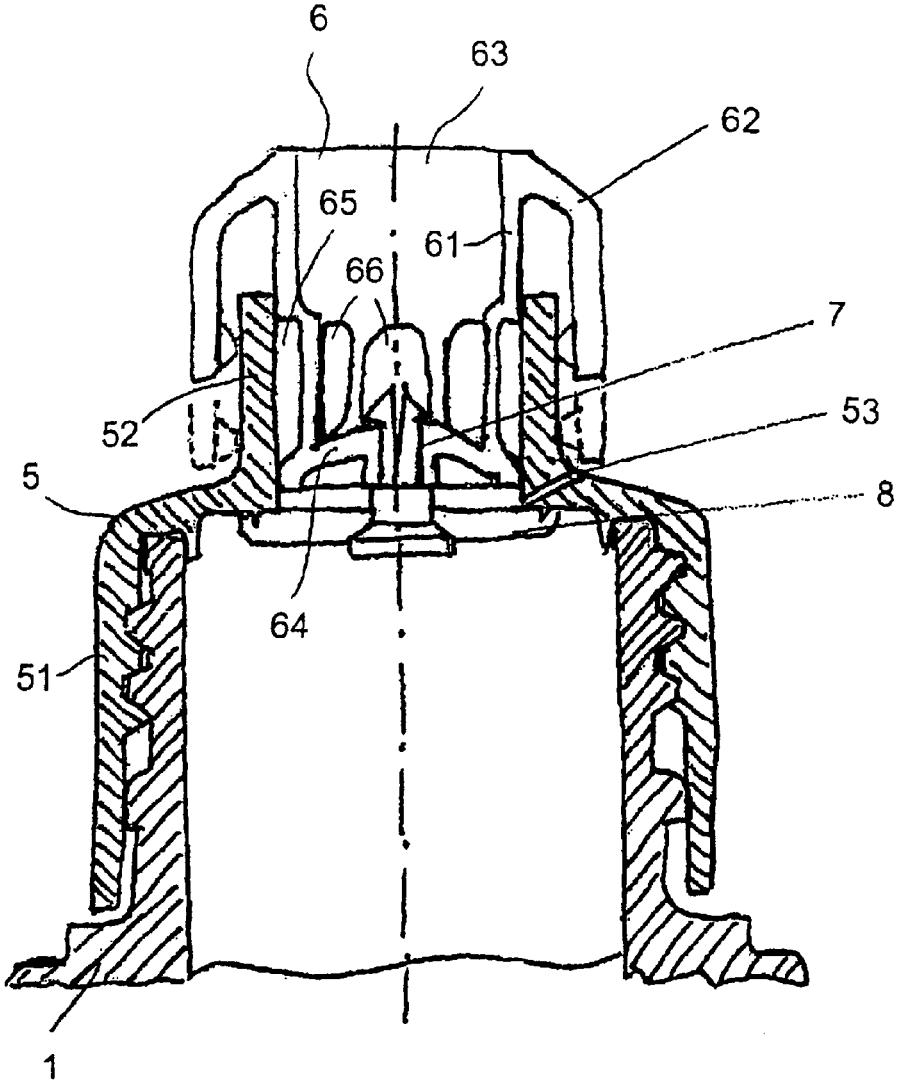
FIG. 5 is a cross section through a second dispensing device according to the invention, in a state in which neither the medium to be dispensed by the dispensing device nor gases can emanate from the container.

A further dispensing device, which likewise has these advantages and the advantages mentioned further above, is illustrated in FIG. 5.

The second dispensing device, which is shown in FIG. 5, comprises a carrier part 5 which is fixed (in the state in which the dispensing device has been fastened on the neck 1), a spout part 6, which can be connected to the carrier part, a pin 7, which is fastened on the spout part 6, and a sealing disc 8 retained by the pin 7.

The carrier part 5 is in the form of a stepped hollow cylinder with a bottom part 51, which has a large diameter, and a top part 52, which has a smaller diameter. The bottom part 51 has an internal thread, by means of which the carrier part 5 can be screwed onto the neck 1 of the bottle. The top part 52 has an external thread, onto which the spout part 6 can be screwed. Provided at the approximate location where the bottom part 51 and the top part 52 come into contact with one another is a pressure-equalizing opening 53 via which, as will be described in more detail at a later stage in the text, a positive pressure or negative pressure prevailing in the bottle may be dissipated.

The spout part 6 comprises an essentially cup-like body 61 with a border 62 which extends from the top end and runs outwards in the first instance and then downwards, essentially parallel to the body 61.

The border 62 has an internal thread, which can be screwed onto the external thread of the top part 52 of the carrier part 5.

The body 61 is open in the upward direction; its top end forms a spout 63 for dispensing the liquid contained in the bottle. In the example in question, the shape and the size of the spout 63 are selected such that an individual can insert the spout 63 into his/her mouth and drink therefrom. It is possible, in principle, for the spout 63 to be of any desired shape and of any desired size; the shape and the size of the spout 63 are preferably made dependent on the intended use of the dispensing device.

The body 61 is closed in the downward direction by a base 64. The centre of the base 64 preferably contains an opening, through which the pin 7 can be plugged.

The body 61 has, in the bottom region, a recess 65 which encircles it over its entire circumference and is provided with through-passages 66.

The sealing disc 8 in the example in question is a circular disc which, in the closed state of the dispensing device, is pressed against the top part 52 of the carrier part 5 from beneath and closes the bottle in a liquid- and gas-tight manner. The centre of the sealing disc preferably contains an opening, through which the pin 7 can be plugged.

The pin 7 has different diameters along its length. It has the largest diameter at its bottom end. There, it has a head with a diameter which is larger than the diameter of the opening provided in the sealing disc 8. Following this, it has a diameter which will be referred to hereinbelow as the medium diameter and corresponds approximately to the diameter of the opening provided in the sealing disc 8, or is somewhat smaller than this. In the assembled state of the dispensing device, the region of the central diameter of the pin 7 extends from the head of the pin 7 to the location at which the pin reaches the base 64 of the body 61; in the assembled state of the dispensing device, the end of that portion of the pin which has the medium diameter butts against the base 64 from beneath. Furthermore, the pin has another, smaller diameter, which will be referred to hereinbelow as the smallest diameter, this smallest diameter corresponding approximately to the diameter of the opening provided in the base 64 of the body 61.

That part of the pin 7 which has the smallest diameter, i.e. the top part, has one or more slits running in the longitudinal direction of the pin 7 from above. The parts of the pin which are separated from one another by the at least one slit can be moved elastically and, at their free ends, have outwardly projecting latching hooks which, in the state in which the pin 7 has been plugged through the opening of the base 64 of the body 61, engage behind the opening and thus prevent the pin 7 from being drawn out of the opening provided in the base 64 of the body 61.

The pin 7 fastens the sealing disc 8 on the body 61. For this purpose, the pin 7 is plugged through the sealing disc 8 from beneath and then—likewise from beneath—is plugged through the base 64 of the body 61.

The operations of opening and closing the dispensing device take place by virtue of the spout part 6 being rotated, to be more precise by virtue of the spout part 6 being screwed onto the carrier part 5 to different extents. The spout part 6 thus moves upwards and downwards relative to the carrier part 5.

The dispensing device is closed when the spout part 6 has only be screwed a little way onto the carrier part 5, and is open when the spout part 6 has been screwed a long way onto the carrier part 5.

FIG. 5 illustrates the state in which the dispensing device is closed. In this case, the spout part 6 has been screwed upwards to such an extent that (via the pin 7) it draws the sealing disc 8 onto the step between the top part 51 and the bottom part 52 of the carrier part 5. In this state, neither liquid nor gas can escape from the region located beneath the sealing disc 8 into the region located above the sealing disc 8; the region located beneath the sealing disc 8 is closed in a liquid- and gas-tight manner.

If, starting from this state, the spout part 6 is screwed further onto the carrier part 5, then the spout part 6 moves downwards relative to the carrier part 5. As the spout part 6 moves, the pin 7 also moves downwards (the base 64 of the spout part 6 presses against the step which is present between that portion of the pin which has the smallest diameter and that portion of the pin which has the medium diameter).

It is possible here for gas to flow out of the region located beneath the sealing disc 8 into the region located above the sealing disc 8 (when there is positive pressure prevailing in the bottle) or vice versa (when there is negative pressure prevailing in the bottle). The gas flows through the opening present in the sealing disc 8 (if the sealing disc 8 maintains its position shown in FIG. 5) and/or flows between the sealing disc 8 and the step which is present between the parts 51 and 52 of the carrier part 5 (if the sealing disc likewise moves downwards). The region which is located above the sealing disc 8, and into which gas flows out of the region located beneath sealing disc 8 or out of which gas flows into the region located beneath the sealing disc 8, is connected to the surroundings of the dispensing device via the pressure-equalizing opening 53 which has already been mentioned above. It is thus possible for a positive pressure or negative pressure which is present in the bottle to be completely dissipated via the pressure-equalizing opening 53. During this pressure equalization, it is still not possible for any liquid to pass out of the spout. For this purpose, the spout part 6 has to be screwed further onto the carrier part 5. It is also the case that, at most, only a negligibly small amount of liquid, if any at all, can pass outwards via the pressure-equalizing opening 53. The routes which the liquid would have to take are too narrow for this purpose.

As the spout part 6 is screwed further onto the carrier part 5, the spout part 6 moves further downwards. In this case, finally, the base 64 of the spout part 6 passes the step which is present between the bottom part 51 and the top part 52 of the carrier part 5. Once this has taken place, liquid can pass out of the interior of the bottle into the recess 65 and, from there, on to the spout 63 via the through-passages 66 provided in the recess 65. The dispensing device is open from this point on.

Before the base 64 of the spout part 6 has passed the step which is present between the bottom part 51 and the top part 52 of the carrier part 5, it is not possible for any liquid to be removed from the bottle because the base 64, which slides along the inside of the top part 52 of the carrier part 5, blocks the route of the liquid here to the recess 65.

As the spout part 6 is screwed further onto the carrier part 5, the spout part 6 moves further downwards until, finally, it is completely open.

The position which the spout part 6 has to assume in order for the dispensing device to be completely open is indicated by dashed lines in FIG. 5.

In order for the dispensing device to be closed again, the spout part 6 has to be screwed back again into the position shown in FIG. 5. In this case, the operations described above take place in reverse sequence and in the opposite direction.

The external thread on the top part 52 of the carrier part 5 and the internal thread on the border 62 of the spout part 6 preferably have a very large pitch, with the result that the spout part 6 can be moved from the closed position into the open position by a fraction of a revolution.

A great advantage of the dispensing device described in relation to FIG. 5 is that the spout part 6, which at the same time forms the closure device of the dispensing device which can be actuated in order to move the dispensing device from the open (liquid-dispensing) state into the closed state (in which no liquid is dispensed) and vice versa, has to be moved in the direction of the bottle in order to move the dispensing device into the open state. In contrast to many known dispensing devices, the situation where the dispensing device is moved into the open state by a positive pressure prevailing in the bottle is thus ruled out under all circumstances.

A further great advantage of the dispensing device described in relation to FIG. 5 is the presence of the pressure-equalizing opening 53. This makes it possible for the dispensing device to be moved into the open position with only a small amount of force being applied. The pressure-equalizing opening 53 can also prevent the situations where liquid sprays out of the spout 63 when the dispensing device is moved into the open position, and where the individual drinking from the bottle is able to, or has to, breathe in carbon dioxide or other harmful gases.

In the case of the dispensing device shown in FIG. 5, the pressure-equalizing opening 53 is not closed when the dispensing device is in the open state. This, as has been described above with reference to the first-described dispensing device, may be advantageous. On the other hand, however, it is also readily possible, in the case of the dispensing device shown in FIG. 5, to ensure that the pressure-equalizing opening 53 is wholly or partially closed when liquid can be removed from the dispensing device. Only slight modifications to the dispensing device shown in FIG. 5 are necessary for this purpose. One possibility here is for the spout part 6 not to have any recess 65 with through-passages 66 at the locations which are situated at the pressure-equalizing opening 53 in the open state of the dispensing device. The pressure-equalizing opening 53 is then closed by the niche-free locations of the body 61 when the dispensing device is in the open state.

The dispensing device shown in FIG. 5 thus has essentially the same advantages as the dispensing device shown in FIGS. 1 to 4.

A further advantage of the above-described dispensing devices which has not yet been mentioned is that the pressure equalization has been realized very straightfowardly. In particular, the pressure equalization and the dispensing of the liquid contained in the bottle take place via one and the same opening of the bottle. It is thus possible for the dispensing devices described to be used for any desired conventional bottles and other containers.

For the sake of completeness, it should be mentioned that, both in the case of the dispensing devices described and in the case of other dispensing devices, the construction of the respective dispensing device makes it possible to define as desired the point in time at which the pressure equalization is to begin and at which the pressure equalization is to end.

A wide variety of advantages can be achieved by the dispensing devices described. In particular, the latter are straightforward to use and cannot under any circumstances open of their own accord.

It will be understood without requiring further explanation, the above-described pressure equalization can also advantageously be used, and can be realized with low outlay, for any other desired dispensing devices.

I claim:

1. A closeable dispensing device for dispensing a liquid, viscous or pasty medium from a container, comprising:

a dispensing device body formed with a first opening for dispensing the medium from the container and a second opening for ventilating or venting the container;

an actuatable closure device configured to selectively establish a communicating connection between said first opening and the container and between said second opening and the container;

said closure device, upon being actuated for establishing a connection between said first opening and the container, first establishing a communicating connection between said second opening and the container and only then establishing the connection between said first opening and the container; and wherein the communicating connection between said second opening and the container is interrupted when the communicating connection between said first opening and the container is established.

2. The dispensing device according to claim 1, wherein the container is a drinks bottle.

3. The dispensing device according to claim 1, wherein said second opening is disposed such that a person opening the dispensing device using the person's mouth, is not subject to breathing in gases passing out of said second opening as the container is vented.

4. The dispensing device according to claim 1, wherein said second opening is disposed such that a person positioning said first opening into the person's mouth as the dispensing device is being opened, is not subject to breathing in gases passing out of said second opening as the container is vented.

5. The dispensing device according to claim 1, wherein said closure device is a slide adapted to be displaced transversely to said communicating connection between said first opening and the container.

6. The dispensing device according to claim 5, which comprises a biasing part disposed between the container and said slide, said biasing part pressing elastically against said slide by a positive pressure prevailing in the container.

7. The dispensing device according to claim 1, wherein said closure device is an element movably disposed along the connection between said first opening and the container.

8. The dispensing device according to claim 7, wherein said closure device is moved along the connection by screwing said closure device onto another component of the dispensing device or by unscrewing said closure device.

9. The dispensing device according to claim 7, wherein said closure device is disposed in a first position when the dispensing device is closed, and said closure device is disposed in a second position when the dispensing device is open, and wherein said first position is at a greater distance from the container than said second position.

* * * * *